US005160131A

United States Patent [19]

Leon

[11] Patent Number: 5,160,131

[45] Date of Patent: Nov. 3, 1992

[54] METHOD AND APPARATUS FOR IMPROVING BATTING SKILLS

[76] Inventor: Saturnino Leon, 566 Centre St., Jamaica Plain, Mass. 02130-2068

[21] Appl. No.: 714,271

[22] Filed: Jun. 12, 1991

[51] Int. Cl.[5] ..... A63B 69/40

[52] U.S. Cl. ..... 273/26 D; 124/56; 273/29 A; 273/26 R

[58] Field of Search ..... 273/26 A, 26 D, 29 A, 273/26 R; 124/56, 57, 60, 70, 71

[56] References Cited

U.S. PATENT DOCUMENTS

| | | | |
|---|---|---|---|
| 1,796,937 | 3/1931 | Nedeau et al. | 124/56 |
| 2,129,489 | 9/1938 | Brown | 124/56 |
| 3,911,888 | 10/1975 | Horvath | 124/56 |
| 4,021,036 | 5/1977 | Nelson et al. | 273/29 A |
| 4,207,857 | 6/1980 | Balka, Jr. | 124/56 |
| 4,272,078 | 6/1981 | Vinette | 124/56 |
| 4,575,080 | 3/1986 | Miles | 273/26 R |
| 4,858,921 | 8/1989 | Eustice | 273/26 R |
| 4,865,318 | 9/1989 | Lehmann | 273/26 R |
| 5,002,274 | 3/1991 | Bideman | 273/26 A |

FOREIGN PATENT DOCUMENTS

| | | | |
|---|---|---|---|
| 3428409 | 2/1966 | France | 273/29 A |

*Primary Examiner*—Theatrice Brown
*Attorney, Agent, or Firm*—Robert K. Tendler

[57] ABSTRACT

Batting skills are improved by a practice routine in which a pneumatic ball projection system projects a ball upwardly to a position at which the batter can hit the ball, with the upward projection providing the batter with means for improving his timing. The subject system replaces those systems in which a ball is placed on top of a tee, and also replaces pneumatic systems which merely suspend the ball in mid air at an appropriate batting position. In one embodiment, a plurality of balls are loaded into a chute within a housing, with the chute being angled downwardly. A foot-actuated switch or other timing mechanism removes a barrier at the end of a chute to permit the ball to roll down into a steeply angled conduit which makes an angled connection with a projection tube or barrel having a blower at one end and having an exit nozzle at the other end, with the exit nozzle pointing upwardly such that the initial horizontal ball direction is redirected along a vertical path. The subject system may be utilized both out of doors and indoors, assuming that a net is placed to intercept the ball after is has been hit.

7 Claims, 3 Drawing Sheets

METHOD AND APPARATUS FOR IMPROVING BATTING SKILLS

FIELD OF THE INVENTION

This invention relates to batting practice and more particularly to a method and apparatus for improving the batter's timing and coordination through the upward projection of a ball.

BACKGROUND OF THE INVENTION

Batting practice has traditionally involved either a live pitcher or a pitching machine. In either case a ball is thrown horizontally towards the batter so that he may improve his swing and control. This type of batting practice obviously requires a substantial distance between the pitcher and the batter so that the batter's performance can be improved through judgment of the speed and direction of the horizontally projected ball. Thus, this type of batting practice requires a field, or at least some distance between the pitching machine and the batter.

So-called tees have also been used, in which a shaft is provided with a cup at the top. The ball is placed in the cup until hit by the batter, with the shaft being made flexible so as to be able to take the shock occasioned by batting practice. It will be appreciated that this type of apparatus produces an unnatural spin on the ball, resulting in a different flight path than that which would be expected were the ball to be suspended at the batting position.

As illustrated in U.S. Pat. Nos. 4,858,921; 4,575,080; 4,564,195; and 5,011,144, balls for hitting or stroking practice have been suspended on a column of air, with the ball being suspended in one position. While this type of arrangement eliminates the problem of having a physical tee to support the ball prior to its being hit, the notion of suspending a ball in one position does not provide the batter with means for improving his timing. This is because the ball is suspended, or is intended to be suspended, at one position.

There are of course automatic ball servers such as illustrated in U.S. Pat. Nos. 4,207,857; 4,027,646; 4,094,294; 3,911,888; and 3,584,614. Such a ball throwing machine is also illustrated in U.K. Patent Application No. GB2,057,893A filed Sep. 10, 1980. It is a characteristic of all of these ball throwing machines that the balls are launched or thrown in a substantially horizontal direction, either for stroking such as in tennis, or for hitting such as in baseball.

As mentioned above, all of the horizontal ball throwing machines require substantial distance between the throwing machine and the batter or person stroking the ball, such that these systems are not adapted to apartment or home use, or any indoor use in general.

SUMMARY OF THE INVENTION

In contradistinction to either the fixed mechanical tee, the air-suspended balls, or the horizontally pitched balls, in the subject system pneumatic apparatus is provided for launching the ball in a substantially vertical direction to a position that which it is to be struck. It is the fact of the vertical movement of the ball that provides a timing exercise for the batter because he must meet the ball, not at a fixed position above the plate, but must hit a moving target as the ball moves upwardly.

This significantly improves the batter's timing while permitting the apparatus to be utilized with a ball-catching net for indoor exercise in a room.

Thus, the subject system is designed for home use as well as outdoor use, with the balls being carried in a magazine and dispensed one at a time, in one embodiment under the control of the batter, so that the batter may improve his eye and swing in the convenience of his own home or apartment.

In another embodiment, rather than having the balls Projected upon actuation by the batter, a timing circuit is provided so that the balls are projected at spaced intervals, again in a substantially vertical direction. This provides an even higher degree of difficulty since the batter cannot control the exact time at which the ball is upwardly projected.

In one embodiment, balls are loaded into a downwardly-projecting chute or conduit within a housing, with the balls running downwardly and around to a position at the end of the conduit which is blocked by a finger or other device to prevent balls from going further. The loaded balls come to rest at the base of the conduit and are redirected to a steeply-inclined tube via a slot in a floor at exit port of the conduit. Upon removal of the finger, a single ball within the conduit is permitted to run down the slot and into the steeply-inclined tube which intersects a projection tube at an angle. The ball drops into the projection tube and is forced by air or other fluid which propels the ball out the projection tube after first taking a turn at a nozzle, that converts the lateral direction of the ball to a vertical projection. In one embodiment, velocity is given to the ball by virtue of a blower which is coupled at one end to the projection tube. Alternatively, any source of compressed gas may be used.

In operation, upon actuation of the switch a ball moves down the chute and down the slot where it falls down towards the projection tube, at which point an impinging stream of air drives the ball out the projection tube after an angled turn to project the ball upwardly, as opposed to in a horizontal direction.

In this manner, a dispensing system is provided for balls in which the balls are vertically projected at the batter's convenience or automatically to a position suitable for being hit by the batter.

The steeply-angled tube which intersects the projection tube is provided in one embodiment with at least one aperture which provides air relief.

Note that the balls in one embodiment are projected upwardly at a relatively low velocity of several feet per second. The balls rise and then fall back under the pull of gravity, since the air or gas column does not support the ball after it leaves the nozzle.

The result is improved batting practice through the utilization of an upwardly projected ball as opposed to a suspended ball.

It will be appreciated that the subject invention is not limited to batting practice but can be utilized in any situation in which a ball is to be hit or stroked. The subject system is also not limited to ballgames but can be utilized for physical therapy or in any situation in which eye/hand coordination is to be improved.

In summary, batting skills are improved by a practice routine in which a pneumatic ball projection system projects a ball upwardly to a position at which the batter can hit the ball, with the upward projection providing the batter with means for improving his timing in terms of eye/hand/bat coordination. The subject system replaces those systems in which a ball is placed on top of a tee which projects upwardly from the batting plate, and also replaces pneumatic systems which merely suspend the ball in mid air at an appropriate batting position. In one embodiment, a plurality of balls are loaded into a chute within a housing, with the chute being angled downwardly to a dispensing position. A foot-actuated switch or other timing mechanism removes a barrier at the end of a conduit to permit the ball to roll down into a steeply-angled tube which makes an angled connection with a projection tube or barrel having a blower at one end and having an exit nozzle at the other end, with the exit nozzle pointing upwardly such that the initial horizontal ball direction is redirected along a vertical path. The subject system may be utilized both out of doors and indoors, assuming that a net is placed to intercept the ball after it has been hit.

BRIEF DESCRIPTION OF THE DRAWINGS

These and other features of the subject invention will be better understood in conjunction with the Detailed Description taken in conjunction with the Drawings of which.

DETAILED DESCRIPTION

Figure 1:
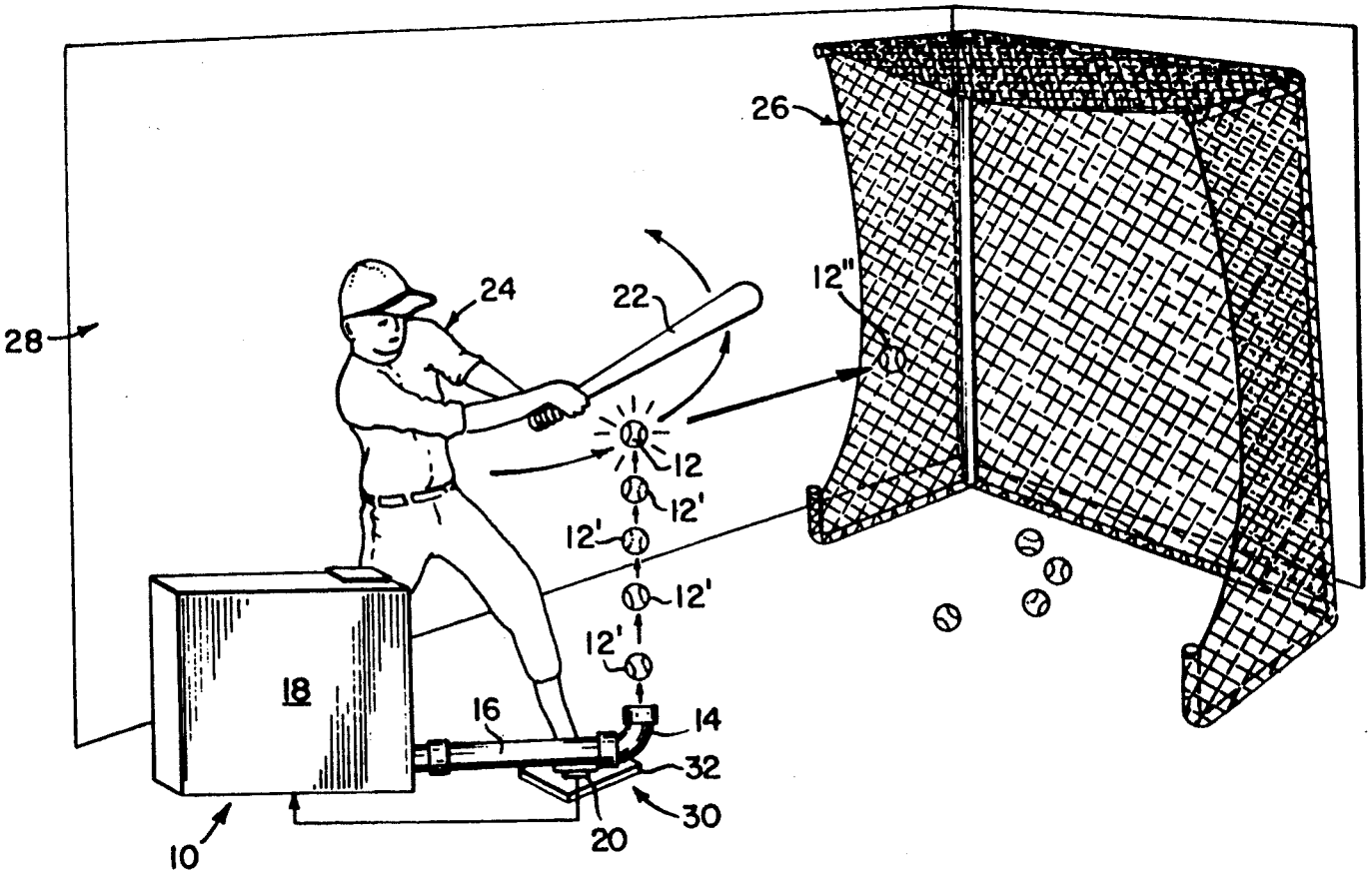
FIG. 1 is a diagrammatic representation of the subject system illustrating the upward projection of a ball at a batting location, showing the striking of the ball and the projection of the ball towards a ball-catching net.

Referring now to FIG. 1, a batting practice machine 10 is illustrated as projecting a ball 12 in a vertically upward direction from a nozzle 14 coupled to a projection tube 16 which extends outwardly from a magazine and dispenser unit 18. Upon actuation of a foot switch 20, a ball from the magazine and dispenser unit 18 is pneumatically projected as illustrated by balls 12' to a position at which the ball is struck by a bat 22 held by individual 24, at which point the ball is directed as illustrated at 12" into a net 26 which is utilized when batting practice is to be performed in a confined space such as in a room 28.

It will be appreciated that the upward movement of the ball improves the batter's timing in terms of his eye/hand coordination. Moreover, due to the localized nature of the projection system, the batting practice apparatus may be located in an exceptionally confined space, with the only critical dimension being that of the batting location as illustrated by arrow 30 to be that associated with home plate 32.

Figure 2:
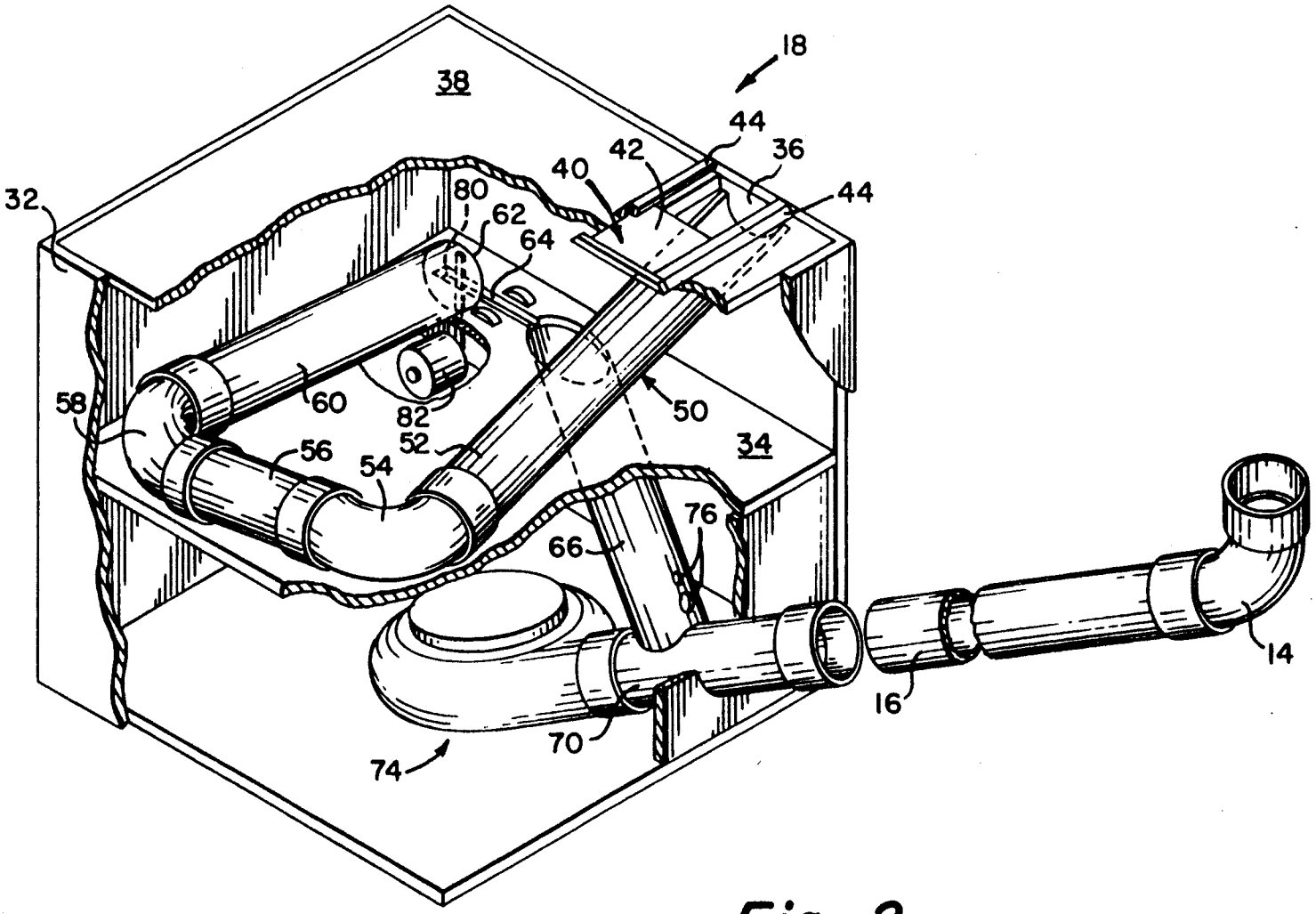
FIG. 2 is a diagrammatic and sectional view of a portion of the apparatus of FIG. 1 showing the ball-dispensing and projection apparatus.

Referring now to FIG. 2, magazine and dispenser 18 includes a housing 32 which is divided in half by a horizontal plate 34, with the housing having an aperture 36 in a top plate 38, and with the aperture being provided with a closure 40 in terms of a slidable lid or plate 42 in appropriate channelled side pieces 44.

A downwardly-projecting chute 50 includes a sloped conduit 52, an elbow 54, an intermediate conduit 56, a second elbow 58, and a further downwardly-positioned exit conduit 60 having an exit port 62 adjacent a slot 64 in plate 34.

This ball channelling arrangement resembles a downward serpentine configuration used to elongate the ball path to accommodate more balls.

Slot 64 is positioned such that a ball in conduit 60 is permitted to roll down the slot and into a steeply-angled conduit 66 which intersects projection tube 16 as illustrated. At an end 70 of projection tube 16 is positioned a blower 74 which provides the pneumatic pressure to force a ball out through the projection tube and through nozzle 14 as illustrated in FIG. 1. A finger 80 or other blocking device blocks exit port 62 and is removable from its blocking position by a motor or other actuating means 82 such that, in operation, upon actuation by switch 20 of FIG. 1, finger 80 is removed momentarily from its position at exit port 62 for a time sufficient to permit a ball at the end of this conduit to transit down slot 64 and into the steeply-angled conduit 66. After the ball enters the steeply-angled conduit, it drops into the flow of air produced by blower 74 and is projected outwardly from the projection tube 16 and upwardly via nozzle 14 which redirects the substantially horizontal movement of the ball to a vertical direction.

Figure 3:
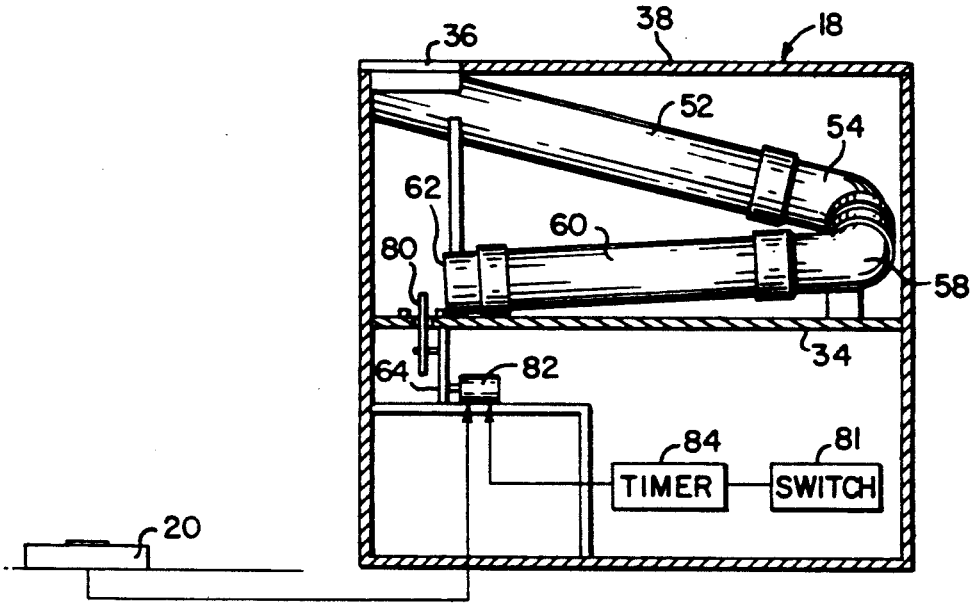
FIG. 3 is a side and sectional view of a portion of the apparatus of FIG. 2, illustrating the one-by-one dispensing of balls to the projection tube; and, FIG. 4 is a side and diagrammatic illustration of the apparatus of FIG. 3, illustrating the path of the ball down through the magazine holding the balls which comprising a chute, a slot, a steeply-angled dispensing tube, and a projection tube.

Referring to FIG. 3, switch 20 may be replaced with a switch 81 coupled to a timer circuit 84 which in turn is coupled to actuator 82 for the movement of finger 80 in a prescribed timed sequence, with actuator 82 driving finger 80 via a geared or other coupling 86 as illustrated.

Figure 4:
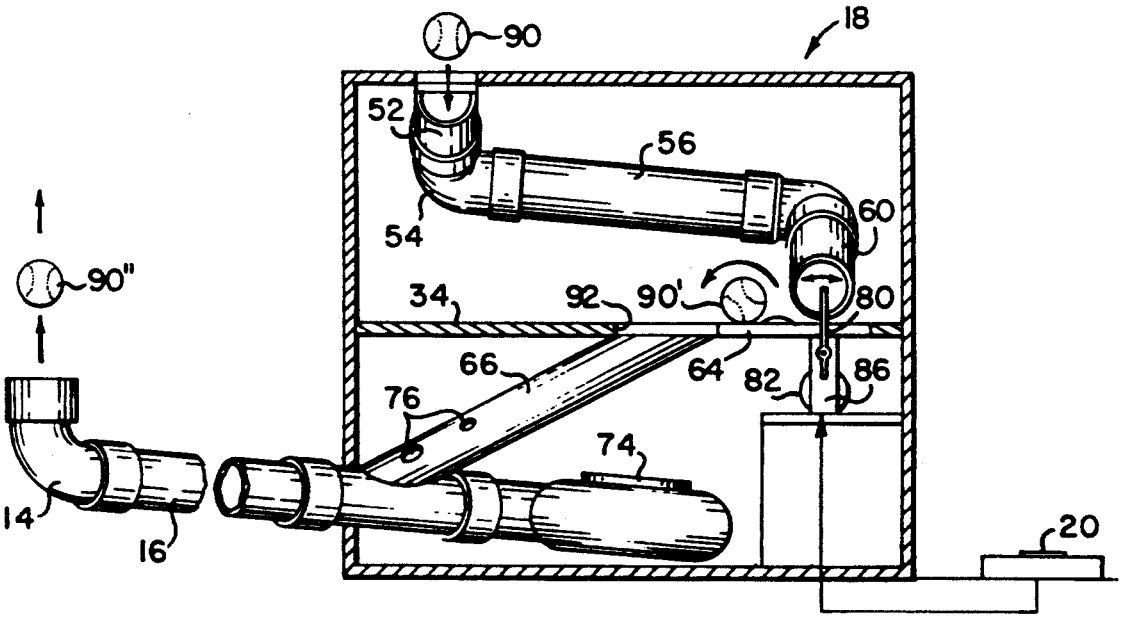

Referring now to FIG. 4, the operation of the system, it is further illustrated in terms of a ball 90 being loaded into chute 52 where it travels across elbow 54 and down conduit 56 to conduit 60 which, as illustrated has finger 80 blocking the exit port thereof. Here it can been seen that ball 90' is projected down slot 64 to an aperture 92 in plate 34 which communicates with conduit 66. Here it can be seen that the relief hole 76 performs the function of preventing the ball from being driven back up conduit 66. As can be seen the result is ball 90" being projected upwardly.

What has therefore been provided is a convenient system for improving batting practice skills, or in fact any skills in which a batting or striking implement is to meet a moving ball or sphere.

It will also be appreciated that while the subject invention has been disclosed in terms of a serpentine coiled or snakelike dispensing system, that the dispensing system can be constructed with a vertically-rising tube directly down into the projection tube. However, the serpentine nature of the tube permits the loading of more balls into the machine.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. Apparatus for use in batting practice comprising means for pneumatically and automatically projecting a series of balls in an upward vertical direction towards a position at which a ball is adapted to be struck by a batter means for adjusting pneumatic pressure such that ball velocity is easily adjusted by pneumatic pressure and such that actuation of ball projection does not throw off batter coordination said projecting means further comprise a downwardly projecting conduit and a substantially horizontally ball projection tube, means for coupling one end of said conduit to said tube, said conduit extending at an inclined angle relative to the longitudinal axis of said tube for movement of balls through said conduit and into said tube, means for producing a flow of gas under pressure through said tube, and means at one end of said tube for redirecting movement of a ball in said tube to a vertical direction.

2. The apparatus of claim 1 wherein said automatic projection means includes means for projecting balls in timed sequence.

3. The apparatus of claim 1 and further including a net spaced from said position and located so as to stop hit balls.

4. The apparatus of claim 1 and further including means for selectively blocking the path of a ball in said conduit such that one ball at a time is introduced into said tube.

5. The apparatus of claim 4 wherein said conduit is serpentine in a downward direction.

6. The apparatus of claim 5 wherein said conduit includes a steeply inclined section coupled to said tube, whereby gravity accelerates a ball downwardly prior to being exposed to the gas flow in said tube.

7. The apparatus of claim 6 wherein said steeply inclined section has at least one aperture therethrough.

* * * * *